United States Patent [19]

Weinstein et al.

[11] 3,946,552

[45] Mar. 30, 1976

[54] FUEL INJECTION APPARATUS

[75] Inventors: Barry Weinstein, Georgetown; Edward Donald Riley, Groveland, both of Mass.

[73] Assignee: General Electric Company, Lynn, Mass.

[22] Filed: Sept. 10, 1973

[21] Appl. No.: 395,605

[52] U.S. Cl. ..... 60/39.74 R; 239/400; 239/404; 239/406

[51] Int. Cl.[2] ..... F02C 7/22; B05B 7/10

[58] Field of Search ..... 60/39.74 R, 39.74 B; 239/400, 403–406

[56] References Cited

UNITED STATES PATENTS

| | | | |
|---|---|---|---|
| 3,474,970 | 10/1969 | Simmons et al. | 239/404 |
| 3,713,588 | 1/1973 | Sharpe | 60/39.74 B |
| 3,811,278 | 5/1974 | Taylor et al. | 60/39.74 R |

FOREIGN PATENTS OR APPLICATIONS

| | | | |
|---|---|---|---|
| 294,941 | 1/1967 | Australia | 239/404 |

*Primary Examiner*—William L. Freeh
*Assistant Examiner*—Robert E. Garrett
*Attorney, Agent, or Firm*—James W. Johnson, Jr.; Derek P. Lawrence

[57] ABSTRACT

An improved fuel injection apparatus is provided to uniformly disperse a low pressure fuel in a highly atomized manner for introduction into a combustion apparatus. The fuel injection apparatus of this invention employs a system of counter-rotating air swirl means disposed about a shroud member whereby the primary atomizing forces are the high shear stresses developed at the confluence of the counter-rotating air streams and the greater velocity and uniformity at which the fuel is dispersed within the shroud provides for a substantially increased atomization efficiency.

8 Claims, 2 Drawing Figures

FUEL INJECTION APPARATUS

CROSS-REFERENCES TO RELATED APPLICATIONS

This application is being filed concurrently with application Ser. No. 395,606 by Enrico Salvi, assigned to the instant assignee, which discloses and claims a generic invention of which the invention disclosed and claimed herein is a species thereof.

BACKGROUND OF THE INVENTION

This invention relates to an improved fuel injection apparatus and, more particularly, to an improved fuel injection apparatus for uniformly atomizing and dispersing fuel supplied to a combustion chamber.

Fuel injection into a continuous flow combustion chamber as, for example, in a gas turbine engine has posed continuing design problems. Difficulties have been encountered in injecting fuel in a highly dispersed manner so as to achieve complete and efficient combustion of the fuel and at the same time minimize the occurrence of fuel rich pockets which, upon combustion, produce carbon or smoke. Fuel injection difficulties have been further complicated by the recent introduction of gas turbine engines having increased combustor pressure and inlet temperature capabilities. Existing fuel spray atomizer efficiency decreases as combustor pressure is increased, resulting in a more non-uniform dispersion of fuel, together with an increase in the fuel rich zones within the combustion chamber. Such zones cause reduced burner efficiency, excessive exhaust smoke, and a non-uniform heating of the combustor shell, a condition commonly referred to as hot streaking, which can lead to rapid deterioration of the shell.

Increasing the fuel pressure to spray atomizers has been suggested as one possible solution. However, the increased weight of a high pressure pump, together with the increased propensity of leaking the volatile high pressure fuel, imposes such a high risk as to make the use of high pressure pumps unlikely, at least within the immediate future.

Recently suggested atomizers for use with low pressure fuel have employed a system of counter-rotational primary and secondary swirl vanes. Some systems have suggested that a fuel/air mixture be introduced upstream of the swirl vanes, whereupon the fuel becomes subsequently atomized upon shearing of the liquid fuel droplets from the swirl vanes. However, such atomizers have been found on occasion to accumulate carbon between the swirl vanes when the inlet airflow and fuel to the atomizer are heated. Present emphasis has centered on developing a system whereby a flow of fuel is introduced within a system of counter-rotational primary and secondary swirl vanes. The fuel is then efficiently atomized by the high shear forces developed at the confluence of the counter-rotating air streams.

Therefore, it is a primary object of this invention to provide a fuel injection apparatus that will uniformly disperse a low pressure fuel in a highly atomized manner for introduction into a combustion apparatus and thus improve upon the performance of the fuel injection apparatus disclosed by Enrico Salvi which itself represents a substantial improvement over prior art devices, It is also an object of this invention to provide a fuel injection apparatus employing a system of counter-rotating swirl means disposed about a shroud member whereby the primary atomizing forces are the high shear stresses developed at the confluence of the counter-rotating air streams.

It is also an object of this invention to provide a fuel injection apparatus employing a system of counter-rotating swirl means disposed about a shroud member whereby the velocity and uniformity at which the fuel is dispersed within the shroud may be substantially increased for greater overall atomization efficiency.

SUMMARY OF THE INVENTION

These and other objects and advantages will be more clearly understood from the following detailed description and drawings, all of which are intended to be representative of, rather than in any way limiting on, the scope of invention.

The fuel injection apparatus of this invention includes a fuel injector having a cylindrical housing. A tubular body is centrally disposed within the cylindrical housing and spaced apart therefrom so as to define a first annular air passage therebetween. Fuel swirl means are disposed within the tubular body in order to impart a swirl to an inlet stream of fuel, with the interior surface of the tubular body converging to a minimum diameter orifice downstream from the swirl member and thereafter diverging outwardly terminating in a transverse edge and generally defining a venturi. Primary swirl means having a plurality of circumferentially spaced apart swirl vanes are disposed intermediate the tubular body and cylindrical housing for swirling an inlet flow of air in the same direction as the fuel swirl. A generally cylindrical primary shroud is coaxially spaced downstream from the fuel injector and defines a central core air passage therethrough. Secondary air swirl means are disposed intermediate the injector and primary shroud to impart a circumferential swirl component to the flow through the core wherein the secondary swirl component is in the same circumferential direction as the fuel swirl and primary air swirl. Tertiary air swirl means are disposed downstream of the secondary air swirl means and impart a circumferential swirl component in the direction opposing that of the secondary swirl means such that fuel reaching the downstream end of the primary shroud is atomized by the shear stresses developed by the counter-rotating aerodynamic forces at the confluence of the secondary and tertiary swirls.

BRIEF DESCRIPTION OF THE DRAWINGS

The invention may be better understood upon reading the following description of the preferred embodiment in conjunction with the accompanying drawings.

DESCRIPTION OF THE PREFERRED EMBODIMENT

Figure 1:
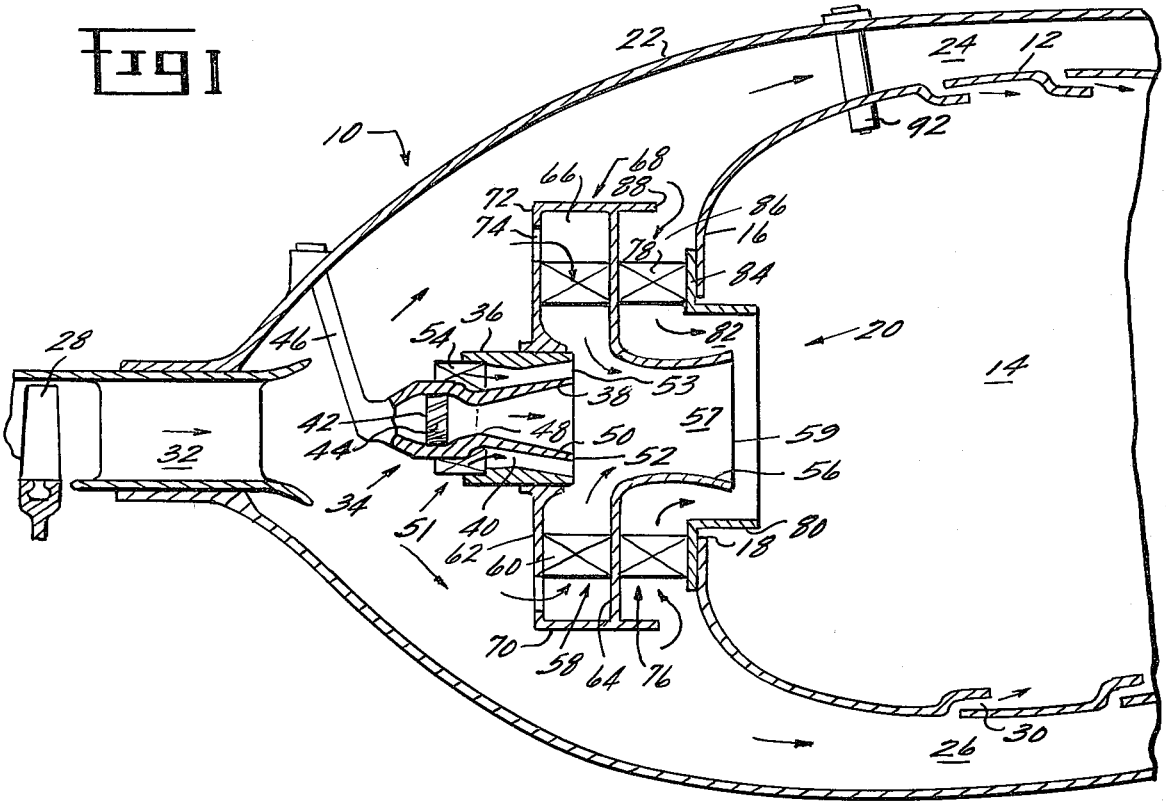
FIG. 1 shows a partial cross-sectional view of a typical combustion chamber of the type suitable for a gas turbine engine and including the fuel injection apparatus of this invention.

Referring now to the drawings, and particularly to FIG. 1, a continuous burning combustion apparatus of the type suitable for use in a gas turbine engine has been shown generally at 10 as comprising a hollow liner 12 defining an annular combustion chamber 14 therein. The hollow liner 12 includes a transverse upstream dome 16 formed integral therewith and having a plurality of openings 18 circumferentially spaced apart about the engine axis, wherein each opening receives an improved fuel injection apparatus 20 of this invention. The upstream dome 16, together with the improved fuel injection apparatus 20, define the upstream end of the combustion chamber 14. The transverse upstream dome 16 may also include a plurality of louvers therethrough which are not shown in the drawings. As will be understood by those skilled in the art, the combustion chamber 14 may also be of the cannular type.

An outer shell 22 is provided around the hollow liner 12 and in cooperation with the hollow liner defines outer and inner passages 24 and 26. As will be understood by those skilled in the gas turbine art, the passages 24 and 26 are adapted to deliver a flow of pressurized air from a suitable source, such as a compressor 28, into the combustion chamber 14 through suitable apertures or louvers 30. The pressurized air is delivered from the compressor 28 through a plurality of circumferentially spaced apart outlet guide vanes 32 whereupon the air is divided between the outer and inner passages 24 and 26 with a portion of the airflow entering the fuel injection apparatus 20. The pressurized air then cools the hollow liner 12 and dilutes the gaseous products of combustion as is well known in the art.

Figure 2:
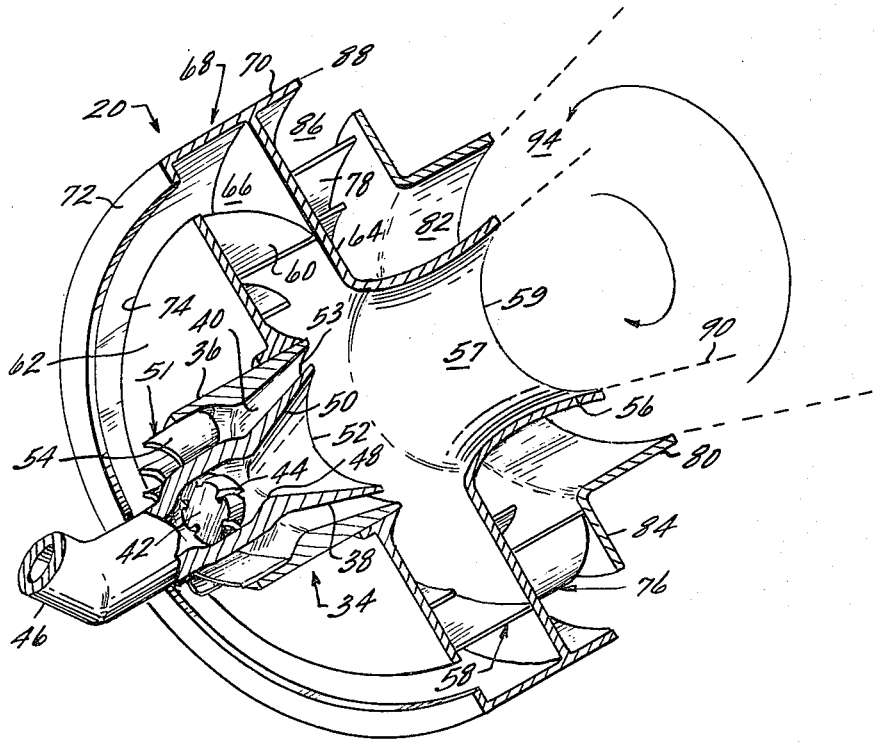
FIG. 2 is an enlarged cross-sectional view in perspective of the fuel injection apparatus shown in FIG. 1.

Referring now to FIG. 2 in conjunction with FIG. 1, the improved fuel injection apparatus of this invention has been shown generally at 20 as including a fuel injector 34 having a cylindrical housing 36 with a tubular body 38 centrally disposed therein so as to define an annular air passage 40 therebetween. The upstream end of the tubular body 38 connects to a fuel delivery conduit 46 for receipt of an inlet flow of fuel. Centrally disposed within the tubular body 38 is a swirl member 42 which includes at least one slot 44 disposed at an angle to the axis of the tubular body. Downstream from the swirl member 42, the interior surface 50 of the tubular body 38 converges to a minimum diameter orifice at 48 and thereafter diverges outwardly, terminating in a sharp edge 52 so as to generally define a venturi. A primary air swirl means shown generally at 51 and comprising a plurality of circumferentially spaced apart swirl vanes 54 is disposed intermediate the tubular body 38 and the cylindrical housing 36 at the inlet to the annular air passage 40. It is preferred that the inner and outer surfaces of the annular air passage 40 converge conically inward to a minimum cross-sectional area and then diverge conically outward so as to define a second venturi coaxially disposed about the first venturi. It is also preferred that the aft edge 52 of the tubular body 38 be co-planar to the aft edge 53 of the cylindrical housing 36 for reasons which will become apparent from the following discussion.

A generally cylindrical primary shroud member 56 is coaxially spaced forward of the fuel injector 34 so as to define a cylindrical core air passage 57 therethrough. Secondary air swirl means shown generally at 58 are provided by a plurality of circumferentially spaced swirl vanes 60. The swirl vanes 60 are maintained in circumferentially spaced relation by disposition between a first radially extending circumferential wall member 62 which is concentric to the fuel injector 34 and a second radially extending circumferential wall member 64 which may be formed integral with the forward end of the primary shroud 56. The secondary air swirl means 58 imparts a swirl component to the radial inflow of air from the compressor 28 wherein the air swirl is in the same circumferential direction as that imparted by the primary swirl means 51 and the swirl member 42. Air from the secondary swirl means 58 is injected radially inward relative to the annular air passage 40 to enhance the centrifuging of the fuel/air mixture emanating from the fuel injector 34. The primary shroud 56 terminates at its downstream end in a generally transverse circumferential edge 59 so as to define the core outlet.

Tertiary air swirl means 76 are provided by a plurality of circumferentially spaced swirl vanes 78 in order to impart a counter-rotating swirl to the radial inflow of air from the compressor 28. The airflow emanating from the tertiary swirl means is in the circumferential direction opposing the airflow from the primary and secondary swirl means. A generally cylindrical tertiary shroud 80 of larger diameter than the primary shroud 56 circumscribes the primary shroud in general coaxial alignment therewith so as to define an annular secondary core 82. The swirl vanes 78 are maintained in circumferentially spaced relation by disposition between the second circumferential wall member 64 and a third radially extending circumferential wall member 84 formed integral with the forward end of the secondary shroud 80.

In order to insure a near uniform velocity and pressure profile for the radial inflow of air to the secondary and tertiary swirl means, there is provided a mini cowling shown generally at 68. The mini cowling 68 includes an outer cylindrical wall 70 in connection to the outer periphery of the second radially extending circumferential wall 64, together with a fourth radially extending circumferential wall member 72 which cooperatively defines first and second annular plenums 66 and 86 respectively. Wall member 72 is spaced radially apart from wall member 62 so as to define an annular opening 74 therebetween which admits pressurized airflow from the compressor 28 to the first plenum 66. The airflow entering plenum 66 is rapidly diffused so as to substantially reduce the variation in velocity and pressure of the inlet airflow to the swirl vanes 60. In like manner, the cylindrical wall 70 is spaced apart from the third wall member 84 to define a second annular opening 88 for the admission of pressurized airflow from the compressor 28 to the plenum 86. The flow entering plenum 86 is also rapidly diffused so as to reduce the variation in the pressure and velocity of the airflow entering the swirl vanes 78.

In operation, liquid fuel, which need not be highly pressurized, is delivered to the fuel injector 34 through the fuel delivery conduit 46. Fuel entering the tubular body 38 is swirled in a clockwise direction by the swirl member 42 as referenced from a point upstream of the fuel injector 34. The velocity of the swirling fuel leaving the swirl member 42 is initially accelerated by the venturi action of the tubular body 38, whereupon the fuel droplets then diverge outward in a vortical flow which films the interior surface 50 of the tubular body 38. The vortical airflows emanating from the primary swirl vanes 54 and the secondary swirl vanes 60 are in the same clockwise circumferential direction as the vortical fuel flow filming the interior surface of the tubular body 38. Thus, fuel reaching the circumferential edge 52 is sheared therefrom and accelerated within the core air passage 57 by the coaction of the vortical airflows emanating from the primary swirl and secondary swirl means.

Whereas the vortical airflows from the primary and secondary swirl vanes are in the same circumferential direction as that of the fuel flow reaching the circumferential edge 52, there is an increase in the rotational velocity imparted to the fuel emanating from the injector 34.

Although the exact dispersion of fuel within the core air passage 57 is very often difficult to predict with great precision, it is believed that a greater portion of the liquid fuel sheared from the circumferential edge 52 is centrifuged radially outward by the co-action of the vortical airflows emanating from the primary and secondary swirl means into direct impingement on the interior surface of the primary shroud 56. Impinging fuel forms a swirling film of liquid fuel on the interior surface of the primary shroud and travels axially downstream in the direction of the transverse circumferential edge 59 of the primary shroud 56. A tertiary counter-rotating vortical airflow emanates from the tertiary swirl vanes 78 in a counter-clockwise direction as also referenced from a point upstream of the fuel injection apparatus 20. Fuel reaching the transverse circumferential edge 59 of the primary shroud 56 is highly atomized by the high aerodynamic shear stresses developed at the confluence of the counter-rotating vortical airflows. A conical area of turbulent airflow exists on the boundary shown generally by the phantom line 90 between the counter-rotating vortical airflows and acts to even further disperse the atomized fuel droplets. It should be readily appreciated that the above described clockwise and counter-clockwise directions have been only arbitrarily established and could be respectively reversed.

It is believed that the majority of atomized fuel droplets are centrifuged into the outer vortical flow shown generally at 94 from where they are driven generally outward toward the hollow liner 12. The high differential velocity component between the counter-rotating vortical flows permits a high relative velocity component for the fuel droplets without having to accelerate the fuel droplets to such a high absolute velocity. As will be understood by those skilled in the art, a suitable igniter 92 is provided within the combustion chamber 14 to provide initial ignition of the combustible air/fuel mixture discharged from the fuel injection apparatus 20. The core of the vortical flow discharged from the fuel injection apparatus 20 remains at a reduced pressure thereby entraining a portion of the hot products of combustion so as to cause a recirculation thereof and maintain continuous ignition within the combustion chamber 14.

It is believed that the improved atomization of fuel by the fuel injection apparatus of this invention is attributable to the increased velocity and uniformity at which the fuel films the interior surface of the primary shroud 56. Increased velocity is imparted to the fuel sheared from the edge 52 by the co-action of the primary swirl means and secondary swirl means, both of which receive high velocity pressurized air from the compressor 28. The interior venturi of the tubular body 38 and the venturi shape of the air passage 40 operate to disperse the fuel in a uniform vortical flow such that the spiraling trajectory of each fuel droplet leaving the injector 34 intersects the interior surface of the primary shroud 56 at a near tangential angle. In this manner a higher velocity may be imparted to the swirling film of fuel which is applied to the interior surface of the primary shroud 56. The co-planar arrangement of the transverse circumferential aft edges 52, 53 of the tubular body 38 and cylindrical housing 36 and the diverging of the downstream end of the air passage 40 conically outward also operate to minimize the accumulation of carbon, the buildup of which could cause a decrease in the inlet airflow through the swirl vanes, eventually decreasing atomization efficiency.

Accordingly, while a preferred embodiment of the present invention has been depicted and described, it will be appreciated by those skilled in the art that many modifications, substitutions, and changes may be made thereto without departing from the invention's fundamental theme.

What is claimed is:

1. A fuel injection apparatus comprising:

a fuel injector having a cylindrical housing, a tubular body centrally disposed within the cylindrical housing and spaced apart therefrom so as to define a first annular air passage therebetween, fuel swirl means disposed within the tubular body for imparting a swirl to an inlet stream of fuel wherein the interior surface of the tubular body converges to a minimum diameter orifice downstream from the swirl member, and thereafter diverges outwardly terminating in a transverse edge so as to generally define a venturi, and a primary air swirl means having a plurality of circumferentially spaced apart swirl vanes disposed intermediate the tubular body and cylindrical housing for swirling an inlet flow of air in the same direction as the fuel swirl;

a generally cylindrical primary shroud coaxially spaced downstream from the fuel injector defining a central core air passage therethrough;

secondary air swirl means disposed intermediate the injector and primary shroud to impart a circumferential swirl component to the flow through the core wherein the secondary swirl component is in the same circumferential direction as the fuel and primary air swirl;

tertiary air swirl means disposed downstream of the secondary air swirl means to impart a circumferential swirl component in the direction opposing that of the secondary swirl means such that fuel reaching the downstream end of the primary shroud is atomized by the shear stresses developed by the counter-rotating aerodynamic forces at the confluence of the secondary and tertiary swirls and wherein the primary swirl means are disposed at the inlet to the first annular air passage, and the inner and outer surfaces of the first annular air passage coverage conically inward to a minimum cross-sectional area and then diverge conically outward so as to define a second venturi coaxially disposed about the first venturi.

2. The fuel injection apparatus of Claim 1 wherein:

the downstream edge of the cylindrical housing is co-planar to the downstream edge of the tubular body.

3. The fuel injection apparatus of claim 2 wherein:

the fuel swirl means includes a fuel swirl member centrally disposed within the tubular body with at least one slot through the swirl member at an angle to the axis of the tubular body.

4. The fuel injection apparatus of claim 2 wherein:

the secondary air swirl means includes a second plurality of circumferentially spaced swirl vanes disposed intermediate a first radially extending circumferential wall member concentric to the fuel injector and a second axially spaced apart radially extending circumferential wall member connected to the primary shroud, and the tertiary air swirl means includes a third plurality of circumferentially spaced swirl vanes disposed intermediate the second wall member and a third axially spaced apart radially extending circumferential wall member.

5. A fuel injection apparatus comprising:

a fuel injector having a cylindrical housing, a tubular body centrally disposed within the cylindrical housing and spaced apart therefrom so as to define a first annular air passage therebetween, fuel swirl means disposed within the tubular body for imparting a swirl to an inlet stream of fuel wherein the interior surface of the tubular body converges to a minimum diameter orifice downstream from the swirl member, and thereafter diverges outwardly terminating in a transverse edge so as to generally define a venturi, and a primary air swirl means having a plurality of circumferentially spaced apart swirl vanes disposed intermediate the tubular body and cylindrical housing for swirling an inlet flow of air in the same direction as the fuel swirl;

a generally cylindrical primary shroud coaxially spaced downstream from the fuel injector defining a central core air passage therethrough;

secondary air swirl means disposed intermediate the injector and primary shroud to impart a circumferential swirl component to the flow through the core wherein the secondary swirl component is in the same circumferential direction as the fuel and primary air swirl;

tertiary air swirl means disposed downstream of the secondary air swirl means to impart a circumferential swirl component in the direction opposing that of the secondary swirl means such that fuel reaching the downstream end of the primary shroud is atomized by the shear stresses developed by the counter-rotating aerodynamic forces at the confluence of the secondary and tertiary swirls; wherein the primary swirl means are disposed at the inlet to the first annular air passage, and the inner and outer surfaces of the first annular air passage converge conically inward to a minimum cross-sectional area and then diverge conically outward so as to define a second venturi coaxially disposed about the first venturi wherein the downstream edge of the cylindrical housing is coplanar to the downstream edge of the tubular body;

the secondary air swirl means includes a second plurality of circumferentially spaced swirl vanes disposed intermediate a first radially extending circumferential wall member concentric to the fuel injector and a second axially spaced apart radially extending circumferential wall member connected to the primary shroud;

the tertiary air swirl means includes a third plurality of circumferentially spaced swirl vanes disposed intermediate the second wall member and a third axially spaced apart radially extending circumferential wall member, and a mini cowling comprising an outer cylindrical wall in connection to the outer periphery of the second wall member and defining first and second annular plenums which respectively direct inlet airflows to the secondary and tertiary swirl means from an external source of pressurized air wherein the pressurized airflow entering each plenum is rapidly diffused in order to reduce the variation in pressure and velocity of the inlet airflow to the respective swirl vanes.

6. The fuel injection apparatus of claim 5 including a fourth circumferential wall member extending radially inward from the forward periphery of the cylindrical wall into spaced relation to the first wall member so as to define a first annular opening to the first plenum, and wherein the downstream edge of the cylindrical wall member is in spaced relation to the third wall member so as to define a second annular opening to the second plenum.

7. A fuel injection apparatus comprising:

fuel injection means;

a generally cylindrical primary shroud coaxially spaced downstream from the fuel injection means defining a central core air passage therethrough;

primary air swirl means disposed intermediate the injector means and primary shroud to impart a circumferential swirl component to the flow through the core wherein the swirl means includes a first plurality of circumferentially spaced swirl vanes disposed intermediate a first radially extending circumferential wall member concentric to the fuel injection means and a second axially spaced apart radially extending circumferential wall member connected to the primary shroud;

secondary air swirl means disposed downstream of the primary air swirl means to impart a circumferential swirl component in the direction opposing that of the primary swirl means such that fuel reaching the downstream end of the primary shroud is atomized by the shear stresses developed by the counter-rotating aerodynamic forces at the confluence of the primary and secondary swirls wherein the secondary swirl means include a second plurality of circumferentially spaced swirl vanes disposed intermediate the second wall member and a third axially spaced apart radially extending circumferential wall member;

and a mini cowling having an outer cylindrical wall in connection to the outer periphery of the second wall member and defining first and second annular plenums which respectively direct inlet airflows to the secondary and tertiary swirl means from an external source of pressurized air wherein the pressurized airflow entering each plenum is rapidly diffused in order to reduce the variation in pressure and velocity of the inlet airflow to the respective swirl vanes.

8. The fuel injection apparatus of claim 7 including a fourth circumferential wall member extending radially inward from the forward periphery of the cylindrical wall into spaced relation to the first wall member so as to define a first annular opening to the first plenum, and wherein the downstream edge of the cylindrical wall member is in spaced relation to the third wall member so as to define a second annular opening to the second plenum.

* * * * *